US005417490A

United States Patent [19]

Hobbs et al.

[11] Patent Number: 5,417,490

[45] Date of Patent: May 23, 1995

[54] TELESCOPING SLIDE ASSEMBLY

[75] Inventors: James D. Hobbs, Plainfield; David A. Funkhouser, Needham, both of Ind.

[73] Assignee: General Devices Co., Inc., Indianapolis, Ind.

[21] Appl. No.: 38,171

[22] Filed: Mar. 29, 1993

[51] Int. Cl.[6] ..... A47B 88/00

[52] U.S. Cl. ..... 312/334.47; 312/334.12; 312/334.32

[58] Field of Search ..... 312/334.7, 334.12, 334.47, 312/334.32, 334.44; 16/82

[56] References Cited

U.S. PATENT DOCUMENTS

| | | |
|---|---|---|
| 2,319,555 | 5/1943 | Premo . |
| 2,496,673 | 2/1950 | Nielsen . |
| 2,728,626 | 12/1955 | Gussack . |
| 2,788,253 | 4/1957 | Gussack . |
| 2,848,294 | 8/1958 | Sandberg . |
| 3,035,873 | 5/1962 | Fall . |
| 3,059,978 | 10/1962 | Fall . |
| 3,092,429 | 6/1963 | Barnes . |
| 3,142,517 | 7/1963 | Ward . |
| 3,450,446 | 6/1969 | Fall et al. . |
| 3,464,744 | 9/1969 | Fall . |
| 3,485,539 | 12/1969 | Fall et al. . |
| 3,488,097 | 1/1970 | Fall . |
| 3,521,939 | 7/1970 | Fall et al. . |
| 3,679,275 | 7/1972 | Fall et al. . |
| 3,687,505 | 8/1972 | Fall et al. . |
| 3,701,577 | 10/1972 | Fischer . |
| 3,738,716 | 6/1973 | Lambert . |
| 3,776,608 | 12/1973 | Fall et al. . |
| 3,801,166 | 4/1974 | York . |
| 3,869,184 | 3/1975 | Lambert et al. . |
| 3,937,531 | 2/1976 | Hagen et al. . |
| 3,950,040 | 4/1976 | Fall . |
| 4,004,841 | 1/1977 | Vander Ley . |
| 4,089,568 | 5/1978 | Fall . |
| 4,101,178 | 7/1978 | Adams et al. . |
| 4,200,342 | 4/1980 | Fall . |
| 4,549,773 | 10/1985 | Papp et al. . |
| 4,560,212 | 12/1985 | Papp et al. . |
| 4,872,734 | 10/1989 | Rechberg . |

FOREIGN PATENT DOCUMENTS

| | | |
|---|---|---|
| 2532532 | 3/1984 | France . |
| 803331 | 10/1958 | United Kingdom . |

*Primary Examiner*—Stephen C. Pellegrino
*Assistant Examiner*—Nancy Mulcare
*Attorney, Agent, or Firm*—Barnes & Thornburg

[57] ABSTRACT

A locking assembly, used for moving articles between a fully retracted position and a fully extended position, comprises, a stationary slide member, an intermediate slide member slideably connected to the stationary slide member, a load-carrying slide member slidably connected to the intermediate slide member for sliding movement relative to the intermediate slide member, and a locking lever rotatably coupled to the load-carrying slide member. The locking lever including an outer grip portion, and a locking portion for locking the load-carrying slide member to the stationary slide member to prevent relative movement between the load-carrying slide member and the stationary slide member when the assembly is fully retracted position, and a ramp portion for preventing the locking portion from locking the load-carrying slide member to the intermediate slide member in response to movement of the load-carrying slide member relative to the intermediate slide member. The locking portion has a curved lip positioned to engage a bevelled edge on the stationary slide member so that an operator has to move the load-carrying slide member in a reward direction toward the fully retracted position in order to allow the locking lever to be rotated to disengage the curved lip from the bevelled edge to allow the load-carrying slide member to move relative to the stationary slide member in a forward direction to an extended position away from the fully retracted position. A ramp surface on the locking portion to cam the locking portion away from bevelled edge that is engaged by the intermediate slide member when the load-carrying slide member is moved relative to the intermediate member slide.

23 Claims, 4 Drawing Sheets

TELESCOPING SLIDE ASSEMBLY

BACKGROUND AND SUMMARY OF THE INVENTION

The present invention relates to telescoping slide assemblies for moving equipment between a fully retracted position and an extended position, and particularly to a slide assembly having at least three slide members and lock mechanisms for locking the slide members in various retracted and extended positions. More particularly, the present invention relates to a telescoping slide assembly that contains mechanisms for controlling unlocking of the slide members during telescoping movement of the slide members between extended and retracted positions.

A conventional telescoping slide assembly typically includes a stationary slide member, a load-carrying slide member, and an intermediate slide member. The intermediate slide member is positioned and configured to move the load-carrying slide member toward and away from the stationary slide member. Typically, a pair of telescoping slide assemblies are positioned in side-by-side spaced-apart parallel relation so that either a load-carrying platform or one or more pieces of equipment can be carried on the two side-by-side load-carrying slide members. It is also common to use a pair of telescoping slide assemblies to support a cabinet drawer between a retracted position inside the cabinet and an extended position outside the cabinet.

The stationary slide member is typically mounted to a fixed frame to anchor the slide assembly. The frame could be a cabinet, a truck bed, or any other suitable platform. For example, it is known to use telescoping slide assemblies to slide heavy pieces of equipment into and out of a truck bed.

Various kinds of equipment or loads can be anchored to the movable load-carrying slide members so that such loads can be moved easily relative to the truck bed or the like during telescoping extension and retraction of the intermediate and load-carrying slide members in each slide assembly relative to the stationary slide members that are anchored to the truck bed. Typically, a telescoping slide assembly is extended and retracted manually by an operator and thus must be capable of moving heavy loads easily and quickly under the control of an operator during loading of equipment onto the truck and unloading of equipment from the truck.

It is known to provide locking interconnections between each of the three slide members so that extension or retraction of the slide members relative to each other can be prevented. This allows a drawer or equipment rack mounted on a pair of telescoping slide assemblies to be extended outward in the extending direction and locked to maintain a desired extended position. Since these locking interconnections must generally be manually engaged and disengaged, separate manual unlocking actions are required before such a drawer or equipment can be extended. The use of a locking mechanism to prevent relative movement of two sliding tracks until manual release of the locking mechanism is known. See, for example, U.S. Pat. No. 4,200,352 to Fall et al.

Typically, as the telescoping slide assemblies extend to move the equipment or load from the retracted position, the slide members lock automatically in a partly extended position. An operator initiates the extension process by actuating a release mechanism to allow the slide members to extend relative to one another. When the intermediate slide member reaches its fully extended position, the load-carrying slide member automatically locks to the intermediate slide member and thereby stops the slide assembly in a partly extended position. In order to continue moving the load to the fully extended position, the operator must actuate the release mechanism a second time to allow the load-carrying slide member to extend to its fully extended position relative to the intermediate slide member. In many applications, the need for a second actuation of the release mechanism is a nuisance. Therefore, telescoping slide assemblies that provide a mechanism for allowing the slide members to fully extend without stopping at a partly extended position would be an improvement over conventional slide assemblies.

Another problem facing some users of telescoping slide assemblies is accidental unlocking of the telescoping slide assemblies. In mobile situations, where the drawers or equipment racks are mounted in a vehicle such as a truck, the slide assemblies are susceptible to inadvertent release during turns or acceleration of the vehicle. For instance, where the slide assemblies are mounted in a truck to support a heavy piece of equipment, the centrifugal force of the heavy equipment accelerating in the turn causes the slide assemblies to overcome the locking mechanism, thereby allowing the slide assemblies to extend. An unexpected extension of the slide assemblies can be especially troublesome when the slide assemblies are supporting heavy equipment or expensive equipment. Therefore, telescoping slide assemblies that incorporate a mechanism to prevent the inadvertent extension of the assemblies during turns or acceleration would provide a substantial improvement over conventional slide assemblies.

According to the present invention, a telescoping slide assembly is provided for moving a load between a fully retracted position and a fully extended position. The telescoping slide assembly includes a load-carrying slide member, an intermediate slide member, and a stationary slide member. The telescoping slide assembly further includes a mechanism for locking the load-carrying slide member relative to the stationary slide member when the assembly is in the fully retracted position. The telescoping slide assembly further includes means for preventing the assembly from locking at a partly extended position during movement between the fully retracted position and the fully extended position.

In preferred embodiments, a locking lever is provided to lock the telescoping slide assembly in the fully retracted position. The locking lever is pivotably coupled to the load-carrying slide member and is positioned to engage locking apertures that are formed in the intermediate and stationary slide members. The locking apertures in the intermediate and stationary slide members are in registry when the slide assembly is in the fully retracted position so that a lip formed on the locking lever can engage a complementary lip formed on the aperture in the stationary slide member. When the lips are engaged, they overlap each other, and the locking lever locks the load-carrying and stationary slide members in the fully retracted position.

The overlap of the lips serves another purpose in addition to locking the slide assembly in the fully retracted position. When a force is applied to the fully retracted slide assembly of such an angle and magnitude that would tend to extend the slide members, the overlap provides a mechanism for maintaining the locking lever in engagement with the locking apertures and preventing inadvertent release of the locking lever, such as might occur during turns or acceleration. Thus, all extending forces must be removed from the telescoping slide assembly in order to release the locking lever and unlock the slide assembly from the fully retracted position, thereby eliminating inadvertent extension of the telescoping slide assembly.

The locking lever is also formed to include a shoulder for locking the load-carrying slide member in its fully extended position relative to the intermediate slide member. The shoulder is sized to fit in a notch formed in the intermediate slide member. The shoulder is positioned to engage the notch when the load-carrying slide member is in its fully extended position relative to the intermediate slide member. It is not necessary that the intermediate slide member be fully extended for the shoulder to engage the notch.

The locking lever is also configured so that it does not automatically establish a locking connection between the load-carrying and intermediate slide member when the intermediate slide member reaches a partly extended position. While the locking lever is engaged with the locking aperture in the stationary slide member in the fully retracted position, the locking lever is also positioned in the locking aperture in the intermediate slide member and blocks the intermediate slide member from moving relative to the stationary slide member. When the locking lever is disengaged from the stationary slide member and the slide assembly is allowed to extend from the fully retracted position, a lifting ramp appended to the locking lever operates to cam the locking lever out of engagement with the locking apertures in the intermediate and stationary slide members. By camming the locking lever out of engagement with the aperture in the intermediate slide member, the lifting ramp prevents the load-carrying slide member from locking to the intermediate slide member during extension at a partly extended position during movement of the load-carrying slide member toward an extended position.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
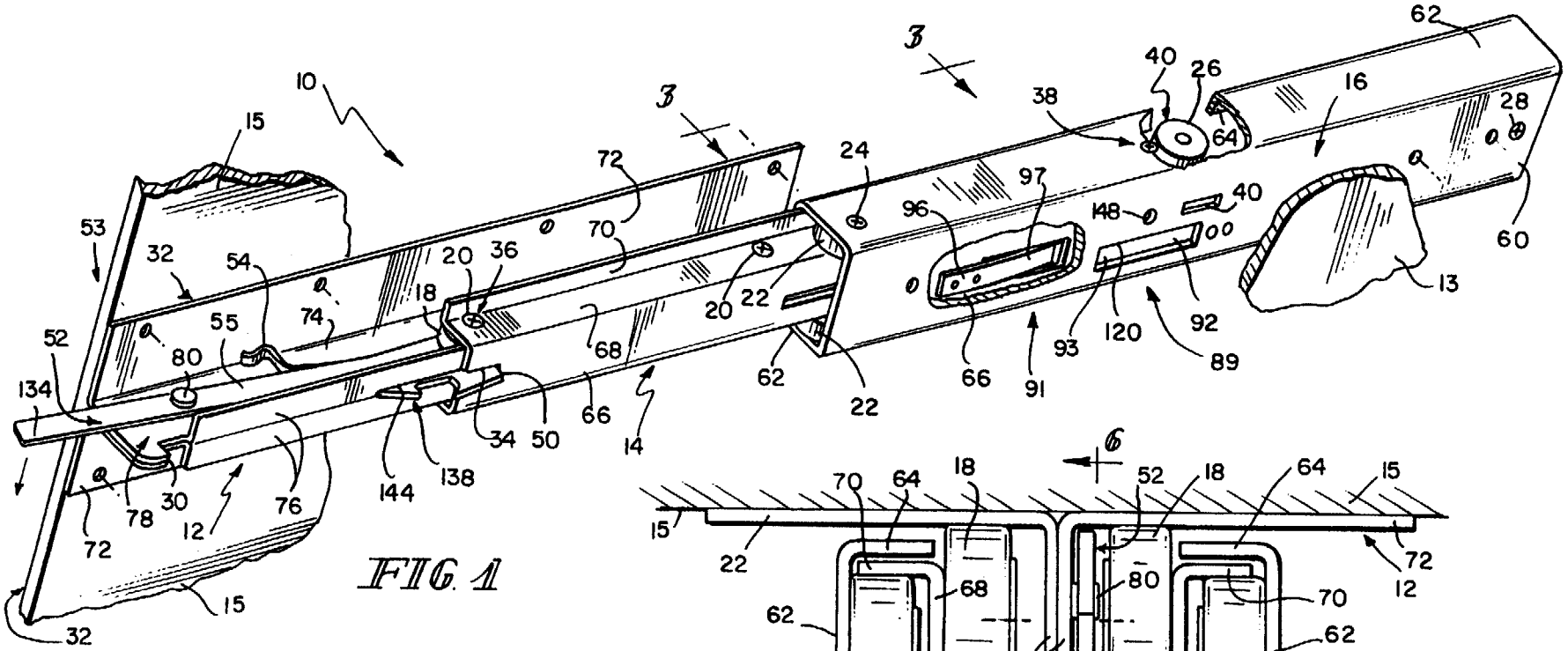
FIG. 1 is a perspective view of a telescoping slide assembly in accordance with the present invention showing three connected slide members arranged in a fully extended position.
Figure 2:
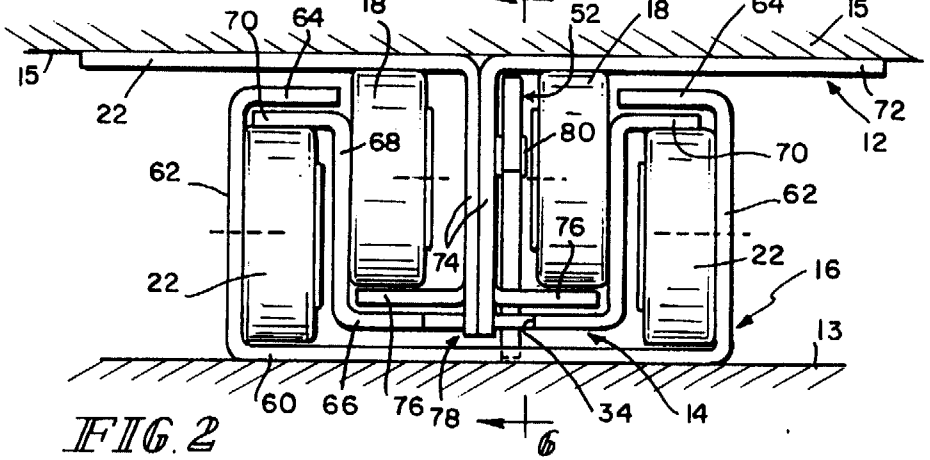
FIG. 2 is an end view of the telescoping slide assembly of FIG. 1 showing a stationary slide member mounted on a frame, a load-carrying slide member carrying a work piece and a pivotable locking lever, and an intermediate slide member therebetween.

The telescoping slide assembly 10 illustrated in FIG. 1 includes three nested and interconnected slide members 12, 14, and 16. A stationary slide member 16 is configured to be mounted on a truck bed 13 or other platform as shown in FIGS. 1 and 2. An intermediate slide member 14 is nested in, and capable of back and forth motion relative to the stationary slide member 16. A load-carrying slide member 12 is configured to support a piece of equipment 15 to be moved as shown in FIGS. 1 and 2. The load-carrying slide member 12 is nested in, and capable of back and forth motion relative to the intermediate slide member 14.

The load-carrying slide member 12 is supported for sliding movement in the intermediate slide member 14 by rollers 18 which are coupled to the intermediate slide member 14 by rivets 20. The intermediate slide member 14 is supported for sliding movement in the stationary slide member 16 by rollers 22 attached to the stationary slide member 16 by rivets 24 and by rollers 26 attached to the rearward end 40 of intermediate slide member 14. These rollers 18, 22, and 26 make it easy for a user to move the slide members 12, 14, 16 relative to one another to move the telescoping slide assembly 10 between a retracted position (shown in FIG. 6) and a fully extended position (shown in FIG. 9).

As illustrated in FIG. 2, the stationary slide member 16 includes a bottom portion 60 positioned between two spaced-apart vertical side walls 62 and arranged to mount on a fixed platform such as a truck bed 13. Horizontal flanges 64 extend inwardly from the vertical side walls 62 to overlie the rollers 22 as shown in FIG. 2. The intermediate slide member 14 includes a bottom portion 66 positioned between two spaced-apart vertical side walls 68. Horizontal flanges 70 extend outwardly from the vertical side wall 68 and are arranged to lie underneath the pair of horizontal flanges 64 of the stationary slide member 16. The horizontal flanges 70 are supported by rollers 22 mounted on the vertical side walls 62 of the stationary slide member 16.

The load-carrying slide member 12 includes a pair of horizontal load-supporting flanges 72 extending outwardly in opposite directions from an upper end of abutting central vertical walls 74. The piece of equipment 15 to be carried by telescoping slide assembly 10 is mounted on the load-supporting flanges 72 as shown best in FIG. 2. Bottom flanges 76 lie in spaced-apart parallel relation to the upper flanges 72 and extend outwardly in opposite directions from a lower end of the central vertical walls 74. The horizontal load supporting flanges 72 are supported by the rollers 18 mounted on the vertical side walls 68 of the intermediate slide member 14.

The vertical side walls 62 of the stationary slide member 16 are sized to allow the rollers 22 to support the horizontal flange 70 of the intermediate slide member 14 for back and forth movement in a plane between the horizontal flange 64 and the roller 22. The vertical side walls 68 of the intermediate slide member 14 are sized to allow rollers 18 to support the horizontal load-supporting flanges 72 of the load-carrying slide member 12 while allowing the bottom flanges 76 of the load-carrying slide member 12 to lie between the rollers 18 and the bottom portion 66 of the intermediate slide member 14.

It is inconvenient to use a telescoping slide assembly that automatically locks to establish a locked partly extended position during movement of the slide members from the fully extended position to a fully retracted position. Although it is expected that it will be necessary to actuate a first release mechanism to unlock the slide members so that they can be moved from a fully extended position toward a fully retracted position, it is a nuisance to operators if they have to actuate a second release mechanism to release the slide members from a locked partly extended position. Therefore, a mechanism that could be added to a telescoping slide assembly to keep it from stopping and locking at a partly extended position would be welcomed by users of slide assemblies.

Figure 3:
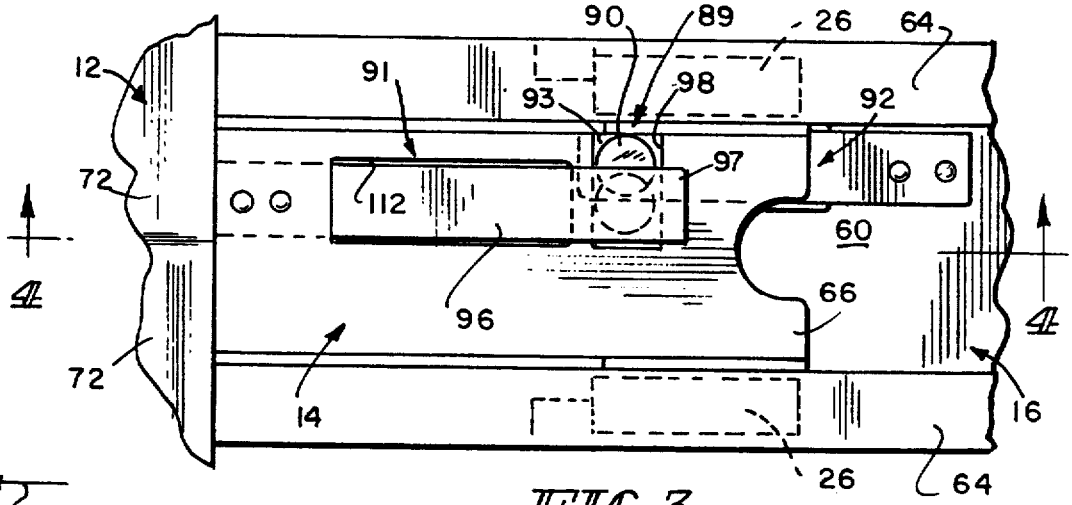
FIG. 3 is a plan view of a portion of the intermediate and stationary slide members taken along line 3—3 of FIG. 1 showing a locking mechanism for locking the intermediate slide member in a fully extended position relative to the stationary slide member and unlocking a companion mechanism for automatically unlocking the locking mechanism during rearward movement of the load-carrying slide member relative to the intermediate and stationary slide members.
Figure 4:
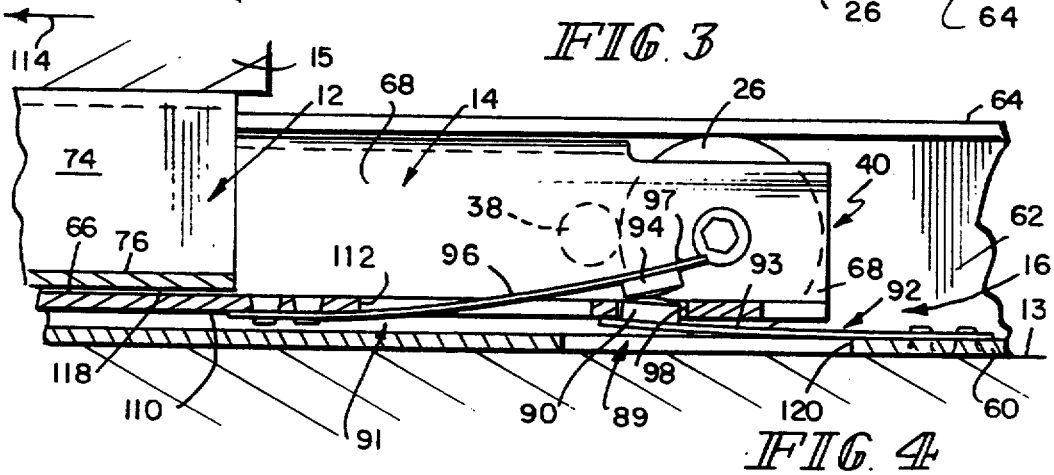
FIG. 4 is a sectional view taken along lines 4—4 in FIG. 3 showing the locking and unlocking mechanisms in more detail and specifically a locked connection wherein a lower button carried on a spring strip fits up into an aperture formed in the intermediate slide member to lock the intermediate slide member in a fully extended position relative to the stationary slide member.
Figure 5:
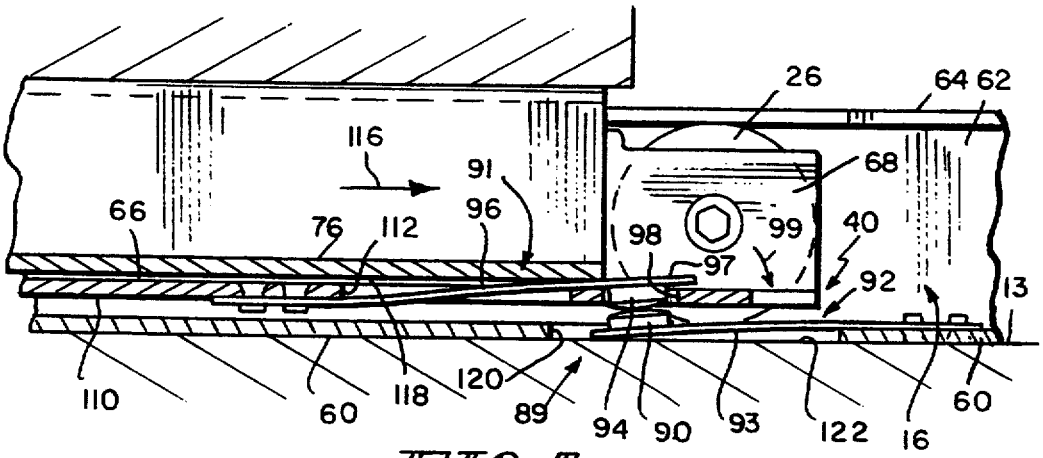
FIG. 5 is a sectional view similar to FIG. 4 showing the operation of the unlocking mechanism and specifically an unlocked connection wherein an upper button carried on a second spring strip is forced downwardly as the rearwardly moving load-carrying slide member bears against this second spring strip to force the lower first button down out of the aperture in the intermediate slide member, thereby allowing the intermediate slide member to move to the right relative to the stationary slide member and with the load-carrying member toward a fully retracted home position.

A locking mechanism 89 for locking the intermediate slide member 14 in a fully extended position relative to the stationary slide member 16 is illustrated in FIGS. 3–5. Portions of this locking mechanism 89 are also visible in FIG. 1 near the left-hand end of the stationary slide member 16. One feature of the present invention is the provision of means 91 for automatically unlocking the locking mechanism 89 in response to movement of the load-carrying slide member 12 from its fully extended position toward its fully retracted position. Advantageously, it is not necessary for a user to unlock the locking mechanism 89 manually whenever the telescoping slide assembly 10 is extended or retracted.

Locking mechanism 89 includes a first button 90 and a strip of spring material 92. The first button 90 is attached to a free end 93 of first spring 92 and a fixed end of first spring 92 is attached to the bottom portion 60 of the stationary slide member 16 as shown in FIGS. 3 and 4. The first spring 92 is aligned so that its free end 93 moves easily into and out of a first spring-receiving aperture 120 formed in bottom portion 60 of the stationary slide member 16.

The unlocking mechanism 91 includes a second button 94 arranged to project downwardly to contact the upwardly projecting first button 90. The second button 94 is attached to a second strip of spring material 96 which has a fixed end that is fastened to the bottom portion 66 of the intermediate slide member 14.

As shown best in FIG. 4, the free end 93 of first spring 92 is positioned to align the first button 90 so that it will fit into a button-receiving aperture 98 formed in the bottom portion 66 of the intermediate slide member 14 during sliding movement of the intermediate slide member 14 relative to the stationary slide member 16. The first spring 92 is biased normally to urge the first button 90 into the button-receiving aperture 98 whenever the intermediate slide member 14 reaches its fully extended position relative to the stationary slide member 16 to lock the intermediate slide member 14 in that extended position.

The fixed end of second button spring 96 is fastened to the underside 110 of the bottom portion 66 of the intermediate slide member 14 as shown in FIG. 4. A middle section of second spring 96 is arranged to pass through a second spring-receiving aperture 112 formed in the bottom portion 66, so that a free end 97 of second spring 96 is arranged to position the second button 94 in confronting relation to the first button 90. The second spring 96 is biased to urge the second button 94 downwardly into contact with the underlying first button 90 whenever their paths cross as shown in FIGS. 3–5. However, the biasing force generated by the second spring 96 is not sufficient by itself to displace the first button 90 and move the first button 90 out of the button-receiving aperture 98 formed in the intermediate slide member 14.

Movement of the load-carrying slide member 12 in the direction of arrow 114 toward its fully extended position allows the first and second button springs 92, 96 to assume their normal positions, wherein the first button 90 is projected by first spring 92 into the button-receiving aperture 98 and is placed in contact with the second button 94 as shown in FIG. 4. The spring force generated by first spring 92 is greater than the spring force generated by second spring 96 to cause the first button 90 to fit into the button-receiving aperture 98 and effectively displace the second button 94 so that it does not fit in the button-receiving aperture 98. Nevertheless, the second spring 96 does generate enough spring force to maintain the second button 94 generally in contact with the first button 90 regardless of the relative positions of the intermediate slide member 14 and the stationary slide member 16.

Movement of the load-carrying slide member 12 in direction of arrow 116 toward a retracted position, as illustrated in FIG. 5, actuates the unlocking mechanism 91 to cause the locking mechanism 89 to disengage the intermediate slide member 14 automatically. The underside 118 of the bottom flange 76 of the load-carrying slide member 12 engages the middle section of the second button spring 96 and deflects the free end 97 of spring 96 downwardly in direction 99 forcing the second button 94 to push the first button 90 out of engagement with the button-receiving aperture 98. When the first button 90 is clear of button-receiving aperture 98, the intermediate slide member 14 is free to retract in direction of arrow 116. As the intermediate slide member 14 continues to retract, the first button 90 is held in position in the first spring-receiving aperture 120 by the underside 110 of bottom flange 66 of the intermediate slide member 14.

Advantageously, the first button 90 and first button spring 92 fit within the volume defined by the underside 110 of the bottom portion 66 of the intermediate slide member 14, the first button-receiving aperture 120, and the top surface 122 of the platform 13 that supports the telescoping slide assembly 10. Therefore, the locking mechanism 89 and companion unlocking mechanism 91 can be mounted on a platform without the need for alterations to the platform 13 to accommodate the first button spring 92.

A locking lever 52 is mounted on the load-carrying slide member 12 as shown in the Figures. This locking lever 52 is pivotable to control locking of the load-carrying slide member 12 to the intermediate slide member 14. The locking lever 52 is arranged as shown best in FIG. 1 to be accessible to an operator able to reach the front end 53 of the telescoping slide assembly 10.

The locking lever 52 includes an elongated handle portion 130 and a blade portion 132 as shown in detail in FIGS. 6–9. Rivet 80 pivotally couples the handle portion 130 of the locking lever 52 to the abutting central vertical walls 74 of the load-carrying slide member 12. The locking lever 52 is positioned so that a distal end portion 134 extends beyond the distal end 32 of the load-carrying slide member 12. The blade portion 132 constitute a locker portion that includes a triangular lug 138 and an oblong lug 139 as shown best in FIG. 6. These locking lugs 138, 139 cooperate to lock the slide members 12, 14, 16 in various positions as shown in FIGS. 6–9.

A spring 54 is positioned to lie between one of the horizontal load-supporting flanges 72 and the top edge 55 of the locking lever 52 to bias the locking lever 52 normally to the position shown in FIG. 1. The spring 54 includes a precurved portion 57 contacting the horizontal load-supporting flange 72 and a flat blade 59 resting against the top edge 55 of locking lever 52. The spring 54 is situated to lie between the pivot post 80 and the blade portion 132 as shown best in FIG. 6.

Figure 6:
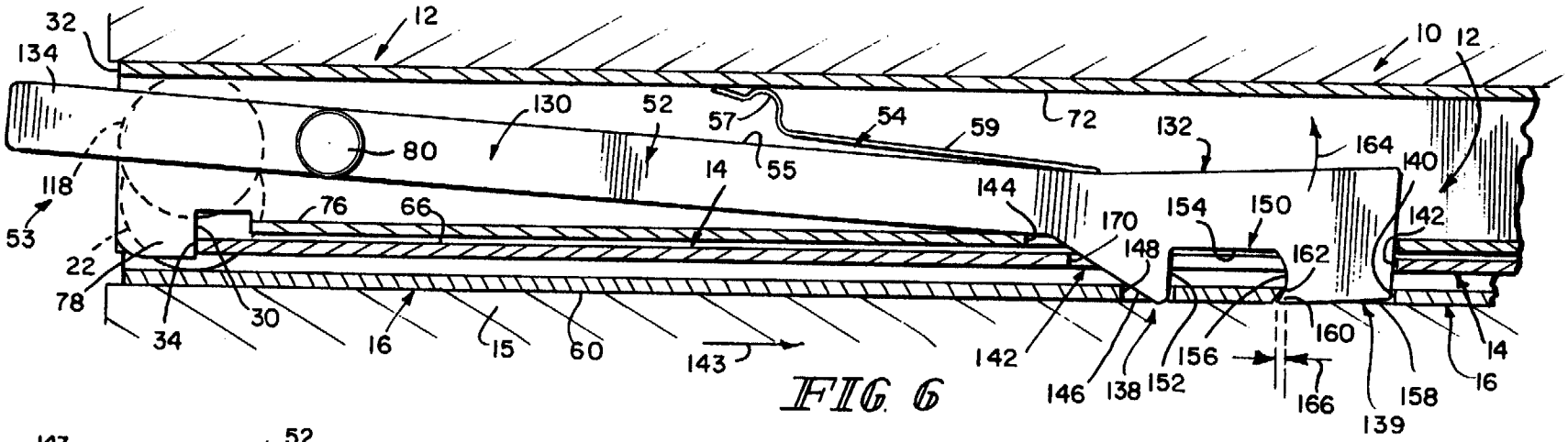
FIG. 6 is a sectional view taken along lines 6—6 of FIG. 2 showing a locking lever engaging various apertures formed in the intermediate and stationary slide members, thereby locking the telescoping slide assembly in its fully retracted position.

When the telescoping slide assembly 10 is in the fully retracted position shown in FIG. 6, first, second, and third rectangular locking apertures 140, 142, 144 formed in the stationary, intermediate, and load-carrying slide members 16, 14, 12, respectively, are vertically aligned in registry with each other. The blade portion 132 of locking lever 52 is urged downwardly by the action of the spring 54 to engage the locking apertures 140, 142, 144 to lock the telescoping slide assembly 10 in the fully retracted position as shown in FIG. 6. The spring 54 urges the triangular locking lug 138 into apertures 144, 142, and 148 and the oblong locking lug 139 into apertures 144, 142, and 140 to establish the locked condition shown in FIG. 6.

An inclined lifting ramp 146 is provided on a forward facing edge of triangular locking lug 138 as shown in FIG. 6. Lifting ramp 146 fits into the lifting ramp aperture 148 formed in the stationary slide member 16 whenever the telescoping slide assembly is moved to its retracted position. The lifting ramp 146 cooperates with vertical edge 152 to define the triangular shape of locking lug 138 that extends downwardly away from the blade portion 132.

The locking lugs 138, 139 are situated in spaced-apart relation to form a notch 150 therebetween in the blade portion 132 of locking lever 52. The notch 150 is defined by a forward vertical edge 152, a rear curvilinear edge 156, and a horizontal edge 154 extending between the rear curvilinear edge 156 and the forward vertical edge 152. The curvilinear edge 156 of the notch 150 meets a bottom edge 158 of the blade portion 132 as shown in FIG. 6 to form a forwardly extending rounded lip 160. The lip 160 engages a complementary bevelled edge 162 formed on the stationary slide member 16 to define a border edge of the first locking aperture 140.

The first locking aperture 140 is sized and positioned so that when the telescoping slide assembly 10 is fully retracted as shown in FIG. 6, a rear shoulder 50 formed on the blade portion 132 abuts against the rear edges of the first and second locking apertures 140, 142. The lip 160 is just able to swing around and clear the bevelled edge 162 so that an operator is able to push down in direction 143 on the outer end 123 of the locking lever 52 to pivot locking lever 52 and cause the blade portion 132 to move upwardly in direction of arrow 164, and thereby disengage the locking lever 52 from the stationary slide member 16.

Once the blade portion 132 of locking lever 52 has been disengaged from the first locking aperture 140, the intermediate and load-carrying slide members 12, 14 are free to move together relative to the stationary slide member 16. The slide members 12, 14 can be moved in direction 141 as shown in FIG. 7 to extend the telescoping slide assembly 10.

Figure 8:
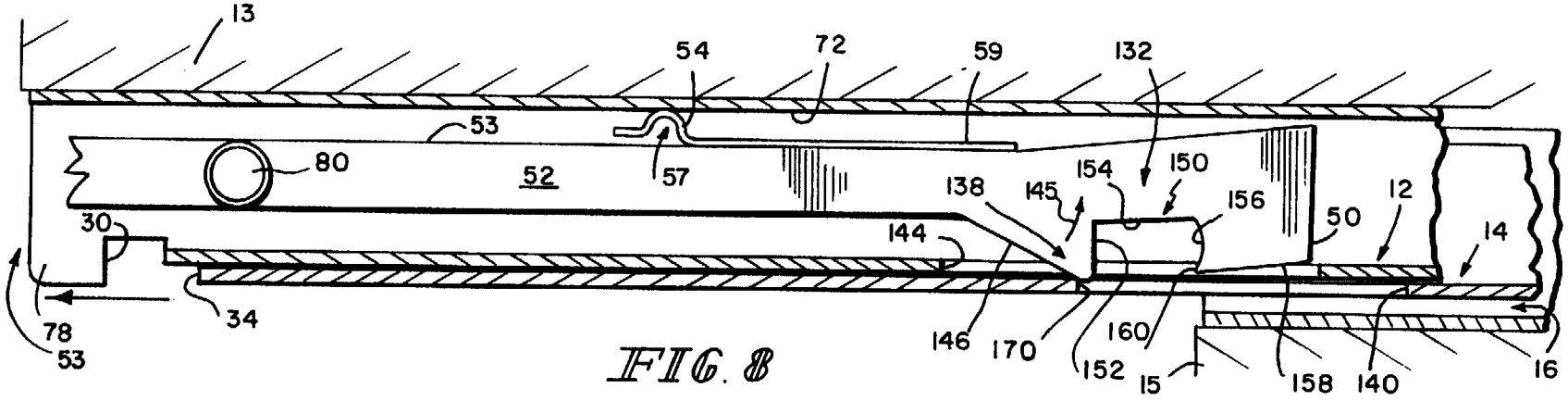
FIG. 8 is a sectional view similar to FIG. 6 showing a lifting ramp provided on the locking lever and configured to block the locking lever from engaging a locking aperture formed in the intermediate slide member, thereby preventing establishment of a locked connection at a partly extended position during extension of the telescoping slide assembly.

When the intermediate slide member 14 has reached its fully extended position as shown in FIG. 4, the first lock button 90 is positioned to engage the lock button-receiving aperture 98 to block further movement of the intermediate slide member 14 relative to the stationary slide member 16. At the same time, the lifting ramp 146 of triangular locking lug 138 engages the forward edge 170 of the second locking aperture 142 formed in the intermediate slide member 14 and lifts the blade portion 132, as shown in FIG. 8. The lifting ramp 146 cams on the bottom portion 66 of the intermediate slide member 14 and keeps the notch 150 from moving downwardly to engage the second locking aperture 142 as also shown in FIG. 8. This camming action by the lifting ramp 146 ensures that the load-carrying slide member 12 will not lock in any position relative to the intermediate slide member 14 except the fully extended and fully retracted positions.

In operation, the telescoping slide assembly 10 is extended by first ensuring that the assembly 10 is in the fully retracted position as shown in FIG. 6 so as to disengage the lip 160 from the bevelled edge 162 in the first locking aperture 140. Until the load-carrying slide member 12 is pushed inwardly a bit in direction 143 so as to move the lip 160 the short distance 166 (FIG. 6) in the direction of retraction, the curvilinear edge 156 will continue to engage the bevelled edge 162 and clear the edge 162 of the aperture 140, the operator will be unable to depress the distal end portion 134 to disengage the oblong locking lug 139 and the bevelled edge 162 and release the locking lever 52. Advantageously, this ensures that the operator is capable of handling any force being applied by the equipment mounted to the assembly tending to extend the assembly. If the operator cannot overcome the force applied by the equipment so as to allow the lip 160 to clear the bevelled edge 162, the operator will be unable to release the locking lever 52.

Figure 7:
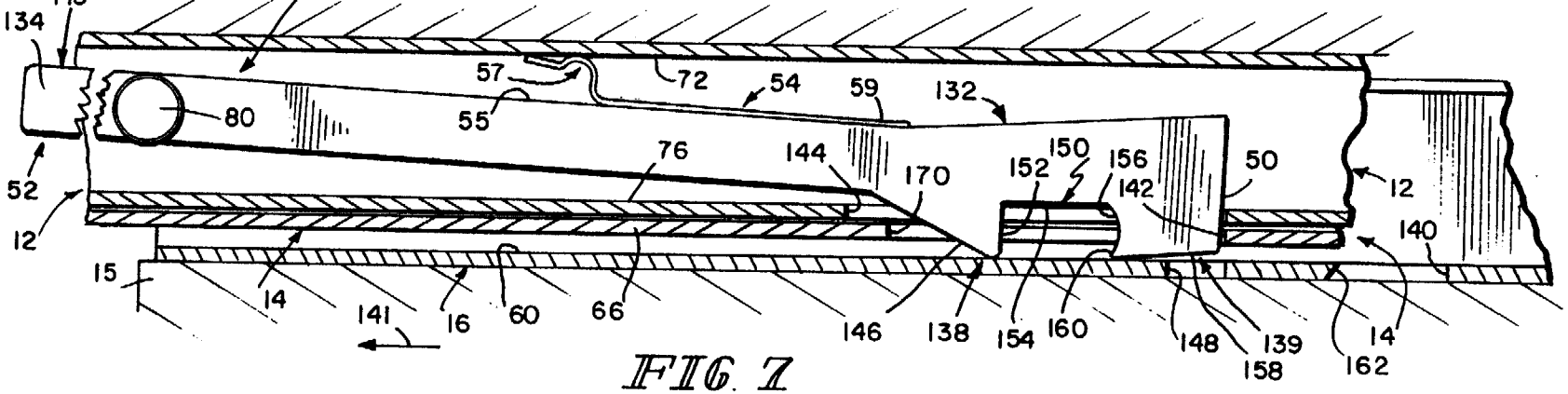
FIG. 7 is a sectional view similar to FIG. 6 showing the position of the locking lever after it has been pivoted in a counterclockwise direction to a release position so that the load-carrying and intermediate slide members are free to move to the left relative to the stationary slide member toward a fully extended position.

When the locking lever 52 has been disengaged from the first locking aperture 140, the load-carrying and intermediate slide members 12, 14 are free to extend relative to the stationary slide member 16 and move in direction 141 as shown in FIG. 7. When the intermediate slide member 14 has fully extended, the roller 26 abuts a stop rivet 38 (FIG. 1) appended to an inner wall of stationary slide member 16 to prevent further extension of the intermediate slide member 14 relative to the stationary slide member 16.

Until the load-carrying slide member 12 extends relative to the intermediate slide member 14, the intermediate slide member 14 is free to retract from the fully extended position. As the load-carrying slide member 12 extends relative to the intermediate slide member 14, the bottom flange 76 exposes the second button spring 96, as illustrated in FIGS. 3 and 4, allowing the spring 96 to move to its unbiased position. Movement of the second spring 96 to its unbiased position allows the first button spring 92 to urge the first button 90 upwardly into the button-receiving aperture 98, as illustrated in FIG. 4, thereby locking the intermediate slide member 14 to the stationary slide member 16.

As the load-carrying slide member 12 continues to extend, the locking lever spring 54 urges the blade portion 132 of the locking lever 52 against the bottom portion 66 of the intermediate slide member 14, but the lifting ramp 146 ensures that the locking notch 150 does not engage the second locking aperture 142 in the intermediate slide member 14. Advantageously, the camming action of the lifting ramp 146 eliminates any intermediate stops between the fully retracted and fully extended positions. Thus, the telescoping slide assembly 10 does not lock automatically in any partly extended position.

Figure 9:
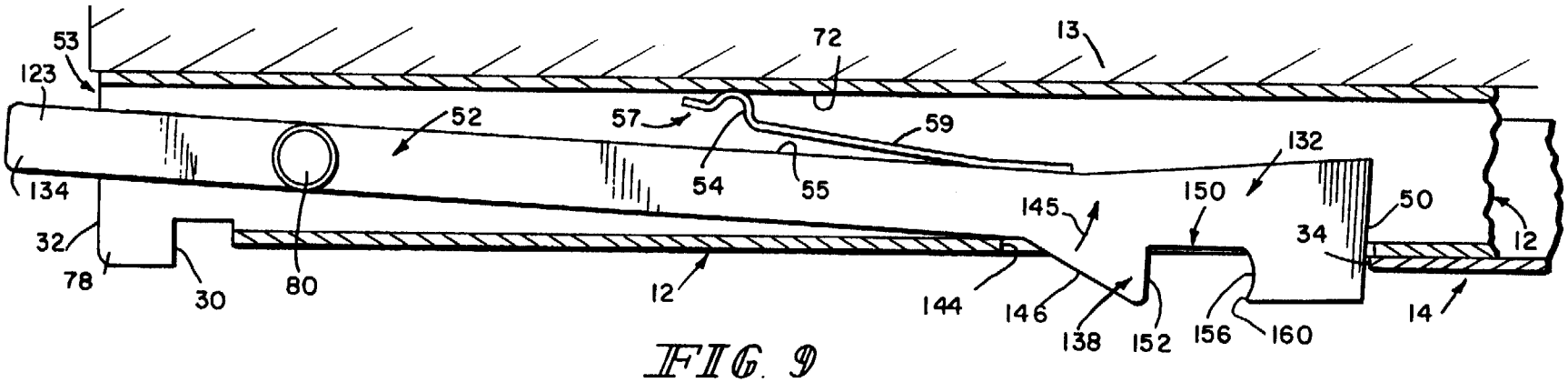
FIG. 9 is a sectional view similar to FIG. 6 showing engagement of a shoulder formed on the locking lever in a notch formed in the intermediate slide member, thereby preventing the load-carrying slide member moving from its fully extended position toward a retracted position relative to the intermediate slide member.

At the fully extended position, the spring 54 urges the shoulder 50 of the blade portion 132 into engagement with the notch 34 formed in the distal end 36 of the intermediate slide member 14, as illustrated in FIGS. 1 and 9. With the intermediate slide member 14 locked to the stationary slide member 16 by the first locking button 90, and with the load-carrying slide member 12 unable to retract relative to the intermediate slide member 14 due to the engagement of the shoulder 50 with the notch 34, the telescoping slide assembly 10 is locked in the fully extended position.

From the fully extended position, the assembly 10 is retracted by depressing the forward end portion 123 of the locking lever 52 to lift the blade portion 132 in direction of arrow 145 and disengage the shoulder 50 from the notch 34. Once the shoulder 50 is disengaged from the notch 34, the load-carrying slide member 12 can retract relative to the intermediate slide member 14 until a downwardly extending shoulder 30 formed on the bottom portion 78 of front edge 53 of the load-carrying slide member 12 engages the notch 34 formed in the intermediate slide member 14.

As the shoulder 30 approaches the notch 34, the rearward end of the bottom portion 66 of the load-carrying slide member 12 contacts and depresses the second button spring 96, as illustrated in FIG. 5. Depressing the spring 96 causes the second button 94 to engage the first button 90 and push the first button 90 out of the button-receiving aperture 98 and allow the intermediate slide member 14 to retract relative to the stationary slide member 16. At the same time, the locking lever spring 54 urges the lifting ramp 146 to slide down the distal edge 170 of the second locking aperture 142 in the intermediate slide member 14, as illustrated in FIG. 8. When the shoulder 30 has engaged the notch 34, the blade portion 132 has fully engaged the second locking aperture 142, as illustrated in FIG. 7, thereafter causing the load-carrying and intermediate slide members 12, 14 to retract together.

As retraction continues, the rearward end 40 of the intermediate slide member 14 contacts the stop rivet 28 mounted on the stationary slide member 16 to prevent further retraction of the intermediate slide member 14 relative to the stationary slide member 16. At the same time, the locking lever spring 54 urges the blade portion 132 into engagement with the ramp aperture 148 and the first locking aperture 140 as illustrated in FIG. 6, thereby locking the telescoping slide assembly 10 in the fully retracted position.

Although the invention has been described in detail with reference to a certain preferred embodiment, variations and modifications exist within the scope and spirit of the invention as described and defined in the following claims.

I claim:

1. A telescoping slide assembly for moving articles between a fully retracted position and a fully extended position, the assembly comprising a stationary slide member, an intermediate slide member slideably connected to the stationary slide member a load-carrying slide member slidably connected to the intermediate slide member for sliding movement relative to the intermediate slide member, a locking lever ratably coupled to the load-carrying slide member, the locking lever including an outer grip portion, a locking portion means for engaging and locking the load-carrying slide member to the stationary slide member and preventing relative movement between the load-carrying slide member and the stationary slide member when the assembly is in the fully retracted position, and means for preventing the locking portion means from locking the load-carrying slide member to the intermediate slide member in response to movement of the load-carrying slide member relative to the intermediate slide member.

2. The assembly of claim 1, wherein the stationary slide member is formed to include a bevelled edge engaging the locking portion means of the locking lever when the assembly is in the fully retracted position.

3. The assembly of claim 2, wherein the locking portion means of the locking lever includes a curved lip positioned to engage the bevelled edge when the assembly is in fully retracted position.

4. The assembly of claim 2, wherein the locking portion means of the locking lever includes means for providing a curved lip positioned to engage the bevelled edge so that an operator has to move the load-carrying slide member in a reward direction toward the fully retracted position in order to allow the locking lever to be rotated to disengage the curved lip from the bevelled edge to allow the load-carrying slide member to move relative to the stationary slide member in a forward direction opposite to the rearward direction to an extended position away from the fully retracted position.

5. The assembly of claim 1, wherein the locking portion means of the locking lever includes a lug formed to include a curved lip engaging the stationary slide member when the assembly is in the fully retracted position.

6. The assembly of claim 5, wherein the stationary slide member is formed to include a bevelled edge positioned to engage the curved lip.

7. The assembly of claim 1, wherein the stationary slide member includes a bevelled edge and the locking portion means of the locking lever includes means for providing a curved lip positioned to engage the bevelled edge so that an operator has to move the load-carrying slide member in a rearward direction toward the fully retracted position in order to allow the locking lever to be rotated to disengage the curved lip from the bevelled edge to allow the load-carrying slide member to move relative to the stationary slide member in a forward direction opposite the rearward direction to an extended position away from the fully retracted position.

8. The assembly of claim 1, wherein the locking portion means of the locking lever includes a lug formed to include a forwardly facing curved lip, a rearwardly facing rear edge, and a bottom edge disposed between the rearwardly facing rear edge and the forwardly facing curved lip.

9. The assembly of claim 8, wherein the bottom edge of the lug is configured to form a rearwardly facing ramp.

10. The assembly of claim 9, wherein the intermediate slide member includes means for engaging the rearwardly facing rear edge of the lug and for locking the intermediate member in the fully retracted position.

11. The assembly of claim 3, wherein the preventing means includes moving for the curved lip to a disengaged position out of engagement with the bevelled edge in response to movement of the load-carrying slide member relative to the intermediate slide member in a forward direction toward the fully extended position and maintaining means for maintaining the curved lip in the disengaged position during movement of the load-carrying slide member relative to the intermediate slide member in the forward direction.

12. The assembly of claim 11, wherein the intermediate slide member includes a bottom wall and a forward engaging edge in the bottom wall, the moving means includes an inclined edge positioned to face in the forward direction and to engage the forward engaging edge and the maintaining means includes a tip portion formed on the locking portion means of the locking lever and configured to engage a surface on the bottom wall of the intermediate slide member and keep the curved lip clear of the forward engageing edge during movement of the load-carrying slide member relative to the intermediate slide member.

13. The assembly of claim 1, wherein the locking portion means of the locking lever means includes a first lug and the preventing means includes a second lug and the first and second lugs are arranged on the locking lever to lie in spaced-apart relation.

14. The assembly of claim 13, wherein the second lug is forward of the first lug.

15. The assembly of claim 13, wherein the intermediate slide member includes a bottom wall including a forward engaging edge and the preventing means includes ramp means formed on the second lug for camming against the forward engaging edge on the intermediate slide member so as to lift the first lug clear of the forward engaging edge on the intermediate slide member during movement of the load-carrying slide member away from the fully retracted position relative to the intermediate slide member and toward the fully extended position.

16. The assembly of claim 15, wherein the preventing means further includes means for keeping the locking portion of the locking lever out of engagement with the forward engaging on the intermediate slide member during relative movement between the load-carrying and intermediate slide members.

17. The assembly of claim 13, wherein the stationary slide member includes a bevelled edge, the first lug includes lip means for engaging the bevelled edge to prevent the rotation of the locking lever during movement of the load-carrying slide member away from the fully retracted position relative to the intermediate slide member, and the second lug includes ramp means for rotating the locking lever and preventing the lip means from engaging the forward engaging edge during movement of the load-carrying slide member away from the fully retracted position relative to the intermediate slide member.

18. The assembly of claim 17, wherein the lip means includes a curved edge and a bottom edge on the locking portion means of the locking lever, the curved edge and the bottom edge cooperating to define a curved lip.

19. A telescoping slide assembly for supporting a movable load, the slide assembly comprising a stationary slide member including a first locking edge, a load-carrying slide member carrying the load relative to the stationary slide member in a forward direction from a fully retracted position to a fully extended position, an intermediate slide member slidably interconnecting the stationary slide member and the load-carrying slide member, the intermediate slide member including a second locking edge, and a locking lever pivotably mounted on the load-carrying slide member, a locking portion means on the locking lever for engaging the first locking edge of the stationary slide member and preventing movement of the load-carrying slide member relative to the stationary slide member, a gripping portion on the locking lever for pivoting the locking lever and moving the locking portion means toward and away from the first locking edge, and ramp means on the locking lever for automatically pivoting the locking lever and maintaining the locking portion means in a disengaged position away from the second locking edge of the intermediate slide member during movement of the load-carrying slide member in the forward direction and movement of the locking portion in the forward direction past the second locking edge to block the locking means from engaging the second locking edge and establishing a locked connection between the load-carrying slide member and the intermediate slide member during movement of the load-carrying slide member in the forward direction away from the stationary slide member.

20. The slide assembly of claim 19, wherein the stationary slide member is formed to include a rearward aperture and a forward aperture, the first locking edge defines a forward border along the rearward aperture, and the ramp means extends into the forward aperture upon engagement of the engaging means and the first locking edge.

21. The slide assembly of claim 20, wherein the first locking edge is inclined to define a bevelled surface.

22. The slide member of claim 21, wherein the engaging means includes a concave, forwardly-presented curved lip engaging the bevelled surface to establish a locked connection between the lock handle and the stationary slide member.

23. The slide member of claim 20, wherein the ramp means is appended to the locking lever to lie between the grip portion and the locking portion means.

* * * * *